US005845439A

United States Patent [19]

Hendley

[11] Patent Number: 5,845,439

[45] Date of Patent: Dec. 8, 1998

[54] ADJUSTABLE DOOR AND FRAME ASSEMBLY

[76] Inventor: Darrell N. Hendley, 4045 Moores Lake Rd., Dover, Fla. 33527

[21] Appl. No.: 959,229

[22] Filed: Oct. 28, 1997

Related U.S. Application Data

[60] Provisional application No. 60/029,193, Oct. 30, 1996.

[51] Int. Cl.[6] ..... E06B 1/04

[52] U.S. Cl. ..... 52/204.1; 52/217; 52/656.4; 49/501; 49/503; 49/505

[58] Field of Search ..... 49/501, 503, 505; 52/204.1, 212, 217, 215, 213, 210, 656.2, 656.4

[56] References Cited

U.S. PATENT DOCUMENTS

| | | | |
|---|---|---|---|
| 1,919,702 | 7/1933 | Murphy . | |
| 2,511,620 | 6/1950 | Clements | 49/503 |
| 2,583,989 | 1/1952 | Bamberg . | |
| 3,186,528 | 6/1965 | Bohnsack | 49/503 |
| 3,808,759 | 5/1974 | Carmichael | 49/505 X |
| 4,589,229 | 5/1986 | Warren . | |
| 4,735,025 | 4/1988 | Day . | |
| 4,813,204 | 3/1989 | Rentschler . | |
| 4,825,610 | 5/1989 | Gasteiger . | |
| 4,908,990 | 3/1990 | Yoon et al. | 49/501 |
| 4,912,879 | 4/1990 | Mozuras et al. | 49/505 |
| 4,922,659 | 5/1990 | Muccioli . | |
| 5,038,538 | 8/1991 | Rozon . | |
| 5,074,087 | 12/1991 | Green . | |
| 5,233,802 | 8/1993 | Rogers . | |
| 5,291,688 | 3/1994 | Pederson . | |
| 5,345,722 | 9/1994 | McKann . | |
| 5,361,552 | 11/1994 | Fulford | 49/501 X |
| 5,528,869 | 6/1996 | Boomer et al. . | |

FOREIGN PATENT DOCUMENTS

| | | |
|---|---|---|
| 2549521 | 1/1985 | France . |
| 2091328 | 7/1982 | United Kingdom . |
| 2141164 | 12/1984 | United Kingdom . |

*Primary Examiner*—Creighton Smith
*Attorney, Agent, or Firm*—Richard C. Litman

[57] ABSTRACT

An adjustable door and frame assembly adapted to fit door openings of different sizes. The door is made up of a core piece having a plurality of height and width extension members which may be removably attached thereto to change the dimensions of the door. The door also has vertically adjustable door knob and hinge receiving assemblies. The frame includes a hinge jamb member, a strike jamb member, and a header member and a plurality of frame extension members which may be attached in varying numbers to the frame members to change the height and width of the frame. All the frame members are made up of a door strike member and a facing member with interfitting tongue and groove assemblies that allow the thickness of the frame to be adjusted. Preferably, all parts of the door are made of a plastic material so that the door is lightweight, easy to clean, and free from warping, swelling, splitting, and rotting.

10 Claims, 7 Drawing Sheets

ADJUSTABLE DOOR AND FRAME ASSEMBLY

CROSS-REFERENCE TO RELATED APPLICATION

This application claims the benefit of U.S. Provisional patent application Ser. No. 60/029,193, filed Oct. 30, 1996.

BACKGROUND OF THE INVENTION

1. FIELD OF THE INVENTION

The present invention relates to doors and frames therefor and, more specifically, to a door and frame assembly adapted to fit differently sized door openings.

2. DESCRIPTION OF RELATED ART

When installing a prefabricated door and frame in a wall opening, it is often necessary to cut the door and frame pieces so that they will properly fit in the opening when the opening is a non-standard or irregular size. This presents an added difficulty when installing a door and frame, and it may even prohibit a person with limited access to tools from installing a door and frame altogether.

Several doors and frames which deal with this problem are described in the prior art. These include doors and frames which are adjustable in height and width and frames which accommodate walls of different thicknesses. However, none of the prior art discloses a door and frame assembly in which the door includes removably attachable height and width extension members, an adjustable door knob receiving assembly, and adjustable hinge receiving assembly, and in which the frame includes removably attachable frame extension members and an interfitting tongue and groove thickness adjustment means so that the frame can accommodate wall openings of different heights, widths, and thicknesses.

U.S. Pat. No. 4,922,659, issued May 8, 1990 to Muccioli, shows an adjustable door and frame assembly in which the height and width of the door adjusts telescopically and in which the height and width of the frame is adjusted by removing pre-cut portions of the header and jamb members. The adjustable door and frame assembly of Muccioli lacks the door height and width extension members, the frame thickness adjustment means, and the removably attachable frame extension members of the present invention.

French document number 2,549,521, dated Jul. 19, 1983 by Michel Francois Robert, shows a door and frame assembly in which the door includes a plurality of narrow height and width extension members that are attached to the sides of a core door piece. This door and frame assembly lacks the adjustable door knob and hinge receiving assemblies and the frame extension members of the door and frame assembly of the present invention.

Other examples of doors which may be adjusted in height and or width are shown in U.S. Pat. No. 2,583,989, issued Jan. 29, 1952 to Bamberg and 5,291,688, issued Mar. 8, 1994 to Pederson which are adjusted by moving an edge portion of the door relative to a central portion. These doors require interfitted moving parts unlike the door of the present invention which is adjusted by adding or removing height and width extension members.

Several patents, including U.S. Pat. No. 1,919,702, issued Jul. 25, 1933 to Murphy, and 5,074,087, issued Dec. 24, 1991 to Green, and British document number 2,141,164, published Dec. 12, 1984 to Halpin, show doors with a plurality of thin members attached to the sides of a core piece. The thin members attached to the sides of these doors may not be attached and removed easily like the width extension members of the present invention, and these doors lack the adjustable knob and hinge receiving assemblies of the door of the present invention.

U.S. Pat. No. 4,825,610, issued May 2, 1989 to Gasteiger and 5,038,538, issued Aug. 13, 1991 to Rozon show door frames with telescoping frame extension members, which allow the frames to be installed in wall openings of various sizes. However, neither of these frames may be adjusted to accommodate walls of different thicknesses Several patents show door frames which may be adjusted to accommodate walls of different thicknesses. The jambs and headers of many of these door frames are made up of two elongated components which are placed on opposite sides of a wall opening and pressed together so that they warp around the wall end. These frames are held together around the door opening either by interengaging rails and channels on the two components as in U.S. Pat. No. 4,735,025, issued Apr. 5, 1988 to Day, 4,813,204, issued Mar. 21, 1989 to Rentschler, and 5,233,802, issued Aug. 10, 1993 to Rogers, or by having interfitting tongues and grooves running longitudinally along their adjacent edges as in U.S. Pat. Nos. 4,582,229, 4,589,229 issued May 20 1986 to Warren, 5,345,722, issued Sep. 13, 1994 to McKann, and 5,528,869, issued Jun. 25, 1996 to Boomer et. al. and in British document number 2,091,328, published Jul. 28, 1981 to Warren. However, none of the above mentioned frames have frame extension members which may be easily attached and removed.

None of the above inventions and patents, taken either singularly or in combination, is seen to describe the instant invention as claimed. Thus, a adjustable door and frame assembly solving the aforementioned problems is desired.

SUMMARY OF THE INVENTION

The present invention is an adjustable door and frame assembly adapted to fit door openings of different sizes. The door is made up of a core piece having a plurality of width extension members removably attached to its hinge side, a plurality of height extension members removably attached to the its bottom side, and a plurality of corner pieces removably attached to the height extension members to bring them flush with the width extension members. The core piece has a door knob receiving assembly therein adjacent its swinging side which may be moved vertically within the door to adjust the height of the door knob, and the end width extension member has a hinge receiving assembly thereon which allows the vertical placement of the hinges to be easily adjusted. Preferably, the core piece and all the extension members are made of a plastic material so that the door is light weight, easy to clean, and free from warping, swelling, splitting, and rotting.

The frame is also preferably made from a plastic material and includes a hinge jamb member, a strike jamb member, and a header member. The hinge jamb member and the strike jamb members have a plurality of frame extension members removably attached to their bottom ends, and they are mitered at their top ends. The header has a plurality of frame extension members removably attached to the middle thereof, and both its ends are mitered to fit together with the top ends of the jamb members to form a frame. The hinge jamb member, the strike jamb member, the header jamb member, and the frame extension members are all made up of a door strike member with a tapered tongue thereon and a facing member with a tapered groove therein. The tapered tongue and groove on the door strike member and facing member allow the frame to be installed on walls of varying thicknesses because when the door strike member and the facing member are placed against opposite sides of a wall end the tapered tongue may extend varying distances into the tapered groove and still provide the frame with a finished appearance.

Accordingly, it is a principal object of the invention to provide a door and frame assembly which may be installed in door openings with different heights, widths and thicknesses with few tools and without cutting.

It is another object of the invention to provide a door and frame assembly which utilizes removably attachable extension members to adjust the size of the door and frame, It is a further object of the invention to provide a door and frame assembly with a door knob receiving assembly which is vertically adjustable.

Still another object of the invention is to provide a door and frame assembly with a hinge receiving assembly which is vertically adjustable.

It is an object of the invention to provide improved elements and arrangements thereof in an adjustable door and frame assembly for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
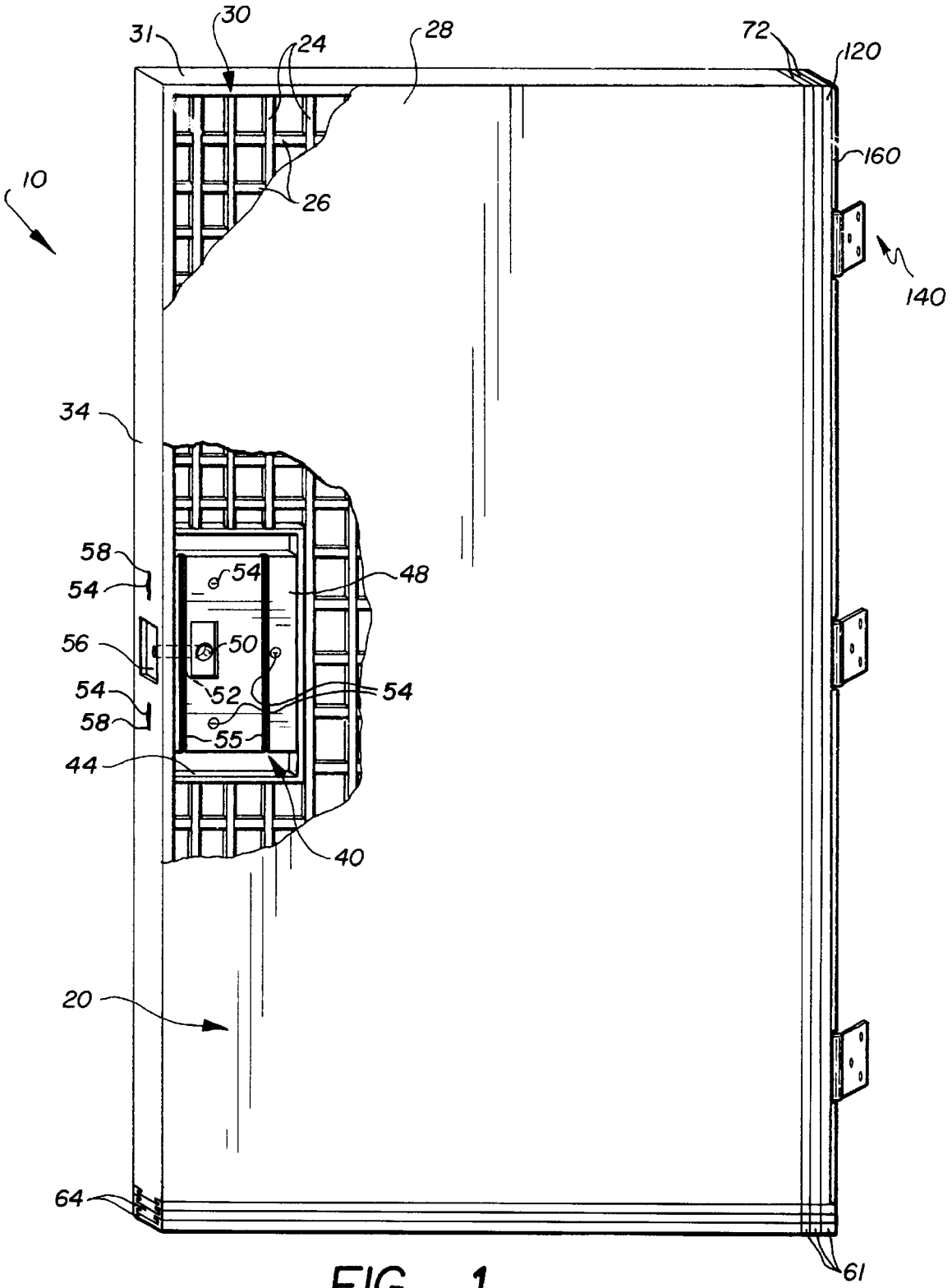
FIG. 1 is a perspective view of the adjustable door of the present invention with sections of the cover piece cut away.

Referring to the drawings, FIG. 1 illustrates an adjustable door 10 made from plastic materials which includes a core piece 20 with a door knob receiving assembly 40 therein and a plurality of height extension members 64, width extension members 72, and corner pieces 61 attached thereto.

The core piece 20 is hollow and includes a core piece Frame 30, vertical support strips 24, horizontal support strips 26, and two cover pieces 28. The support frame is made up of a top member 31, a bottom member 32, a hinge side member 33, and a swinging side member 34 which are joined together to form a rectangle. This is shown in dashed lines in FIG. 2. The ends of vertical support strips 24 attach to the front and rear of top member 31 and to the front and rear of bottom member 32 to define planes on the front and rear sides of the core piece frame 30. The ends of the horizontal support strips 26 attach to the front and rear sides of the hinge side member 33 and to the front and rear sides of the swinging side member 34 to define planes on the front and rear side of the core piece frame 30. The cover pieces 28 are rectangular pieces of sheet material with height and width dimensions that are equal to the height and width dimensions of the core piece frame 30 which are attached to the front and rear sides of the core piece frame 30 over the horizontal support strips 26 and vertical support strips 24 to provide the core piece 20 with a finished appearance.

The door knob receiving assembly 40 is contained within the core piece 20 adjacent the swinging side member 34 and sandwiched between the cover pieces 28. The door knob receiving assembly 40 includes a door knob receiving frame 44 with a door knob receiving block 48 held therein so that it may slide vertically. The door knob receiving frame 44 has a top member, a bottom member, and a hinge side member which are joined with the swinging side member 34 to form a rectangle disposed around the middle of the core piece 20. The horizontal support strips 26 disposed around the middle of the core piece 20 attach to the hinge side member of the door knob receiving frame 44 and the vertical support strips adjacent the swinging side of the core piece 20 attach to the top and bottom members of the door knob receiving frame 44 so that the support strips do not prevent the door knob receiving block 48 from moving vertically within the door knob receiving frame.

The door knob receiving block 48 is in the form of a rectangle with a width and thickness equal to the width and thickness of the door knob receiving frame 44 and a height substantially less than the height of the door knob receiving frame 44. The door knob receiving block has two vertically disposed square grooves 55 in its front and rear face and the cover pieces 28 have square tabs (not shown) extending from their facing sides into the square grooves in the door knob receiving block 48. This arrangement allows the door knob receiving block 48 to be moved up and down within the door knob receiving frame 44 and between the cover pieces 28, but prevents side to side movement.

The door knob receiving block 48 has a knob hole 50 drilled therethrough from its front side to its rear side and a bolt hole 52 drilled therein from its swinging side to the knob hole 50 so that it may hold a door knob assembly therein.

To allow the door knob receiving block 48 to be moved vertically within the door knob receiving frame 44 and then secured in place, the door knob receiving block 48 has a three flat head screws 54 screwed into its front side and two flat head screws 54 screwed into its swinging side. The cover piece 28 on the front side of the core piece 20 has three vertically extending screw slots 58 therein and the swinging side member 34 has two vertically extending screw slots therein through which the flat head screws 54 extend and in which the flat head screws 54 may slide vertically. These can be seen in FIG. 2. The cover pieces 28 on the front and rear side of the core piece 20 have vertically extending knob slots 60 therein, in which a door knob may slide vertically, and the swinging side member 34 of the core piece frame 30 has a vertically extending bolt slot 56 in which a door knob bolt may slide vertically. These slots allow the height of the door knob receiving block 48 to be adjusted after a door knob assembly has been placed therein. The width of the screw slots 58 is less than the diameter of the head of the flat head screws 54 so that when the flat head screws 54 are screwed into the door knob receiving block 48, the cover piece 28 and the swinging side member 34 are clamped against the door knob receiving block 48 to secure the door knob receiving block 48 in place.

The door knob receiving block 48 has two knob slot covers 57, one attached to its front and the other to its rear face. The knob slot covers 57 are thin rectangular strips of material with holes cut therein which are the same size as the knob hole 50 so that the knob slot covers may be secured to the door knob receiving block 48 by an adhesive placed around the knob hole 50 without obstructing the installation of the door knob. The edges of the knob slot covers 57 extend over the knob slots 60 in the cover pieces 28 to hide the knob slots from view and give the door a finished appearance.

The height extension members 64 are long thin strips with top and bottom surfaces of the same dimension as the bottom of core piece 20. The height extension members 64 are removably attached to the bottom of core piece 20 in varying numbers to change the overall height of the door 10.

Figure 3:
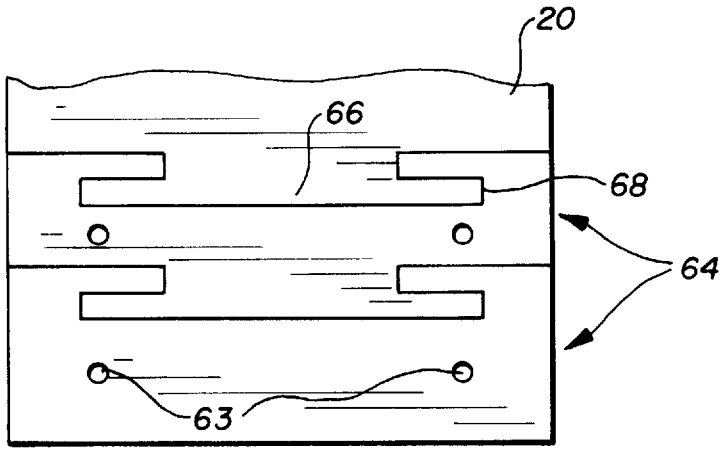
FIG. 3 is a side view of the bottom of the adjustable door of the present invention showing the first embodiment of the height extension member attachment means.

In a first embodiment, the height extension members 64 have a dovetail groove 68 extending longitudinally along their top sides and a dovetail tongue 66 extending longitudinally along their bottom sides so that the height extension members 64 may be removably attached to each other by sliding the dovetail tongue 66 into the dovetail groove 68. The bottom of the core piece 20 also has a dovetail tongue 66 thereon which allows the height extension members 64 to be removably attached to the core piece 20 by sliding the dovetail tongue 66 on the core piece 20 into the dovetail groove 68 on one of the height extension members 64. This can be seen in FIG. 3.

Figure 4:
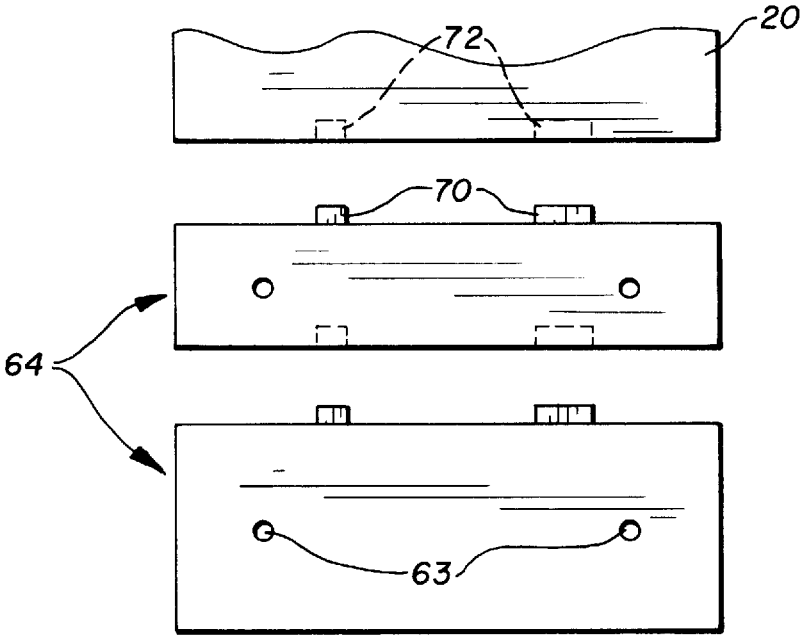
FIG. 4 is an exploded side view of the bottom of the adjustable door of the present invention showing the second embodiment of the height extension member attachment means.

In a second embodiment, the height extension members 64 have two parallel rows of pegs 70 extending perpendicularly from the top surfaces thereof which snap into two parallel rows of peg holes 71 on the bottom surfaces thereof to allow the height extension members 64 to be removably attached to each other. In this embodiment, the core piece 20 also has two parallel rows of peg holes 71 in the bottom side thereof to allow the height extension members 64 to be removably attached thereto. This can be seen in FIG. 4.

In both embodiments, the height extension member 64 which forms the bottom of the door 10 has a flat bottom surface to provide the door with a finished appearance. This is shown in both FIGS. 3 and 4.

The width extension members 72 are long thin strips which fit flush on the hinge side of the core piece 20 to which they are removably attached in varying numbers so that the overall width of the door 10 may be changed. The width extension members 72 have pegs 62 extending from their door side and peg holes 63 in their hinge side which allow the width extension members 72 to be attached to each other and the hinge side member 33 has peg holes therein which allow the width extension members to be attached to the core piece 20. The width extension members 72 and the hinge have bolt holes 76 aligned therethrough which are aligned with threaded holes in the hinge side frame member 33 (shown in dashed lines in FIG. 2) so that bolts 74 may be used to removably and securely attach a variable number of width extension members 72 to the hinge side of the core piece 20.

Figure 2:
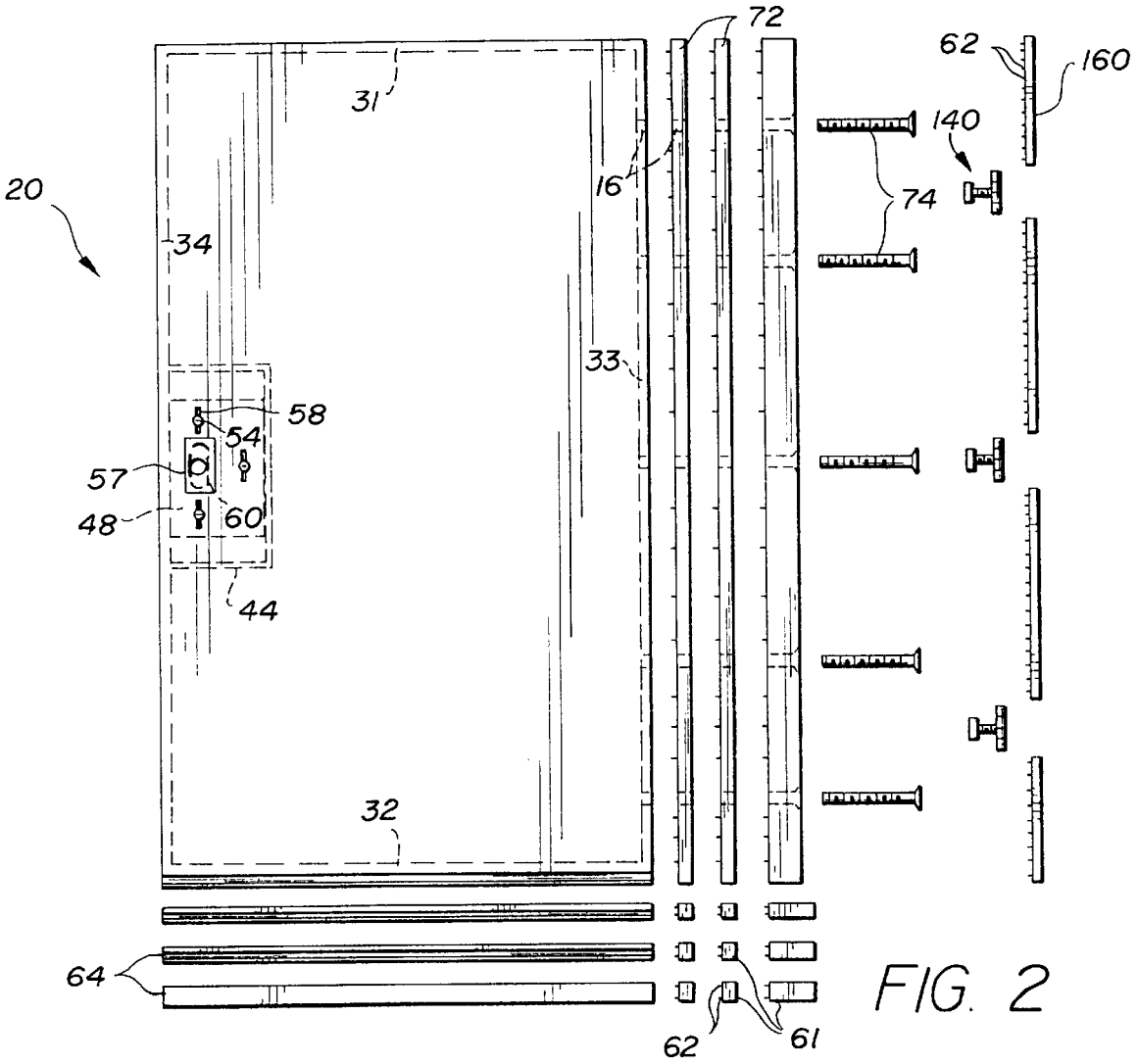
FIG. 2 is an exploded front view of the adjustable door of the present invention.

Attached to the hinge side of the width extension members 72 is an end width extension member 120 having a door side and a hinge side. The end width extension member 120 has a plurality of bolt holes 76 therethrough from the hinge side to the door side which are aligned with the bolt holes 76 in the width extension members 72 and the hinge side member 33 so that the end width extension member 120 may also be removably attached with bolts 74. This is also shown in FIG. 2.

Figure 5:
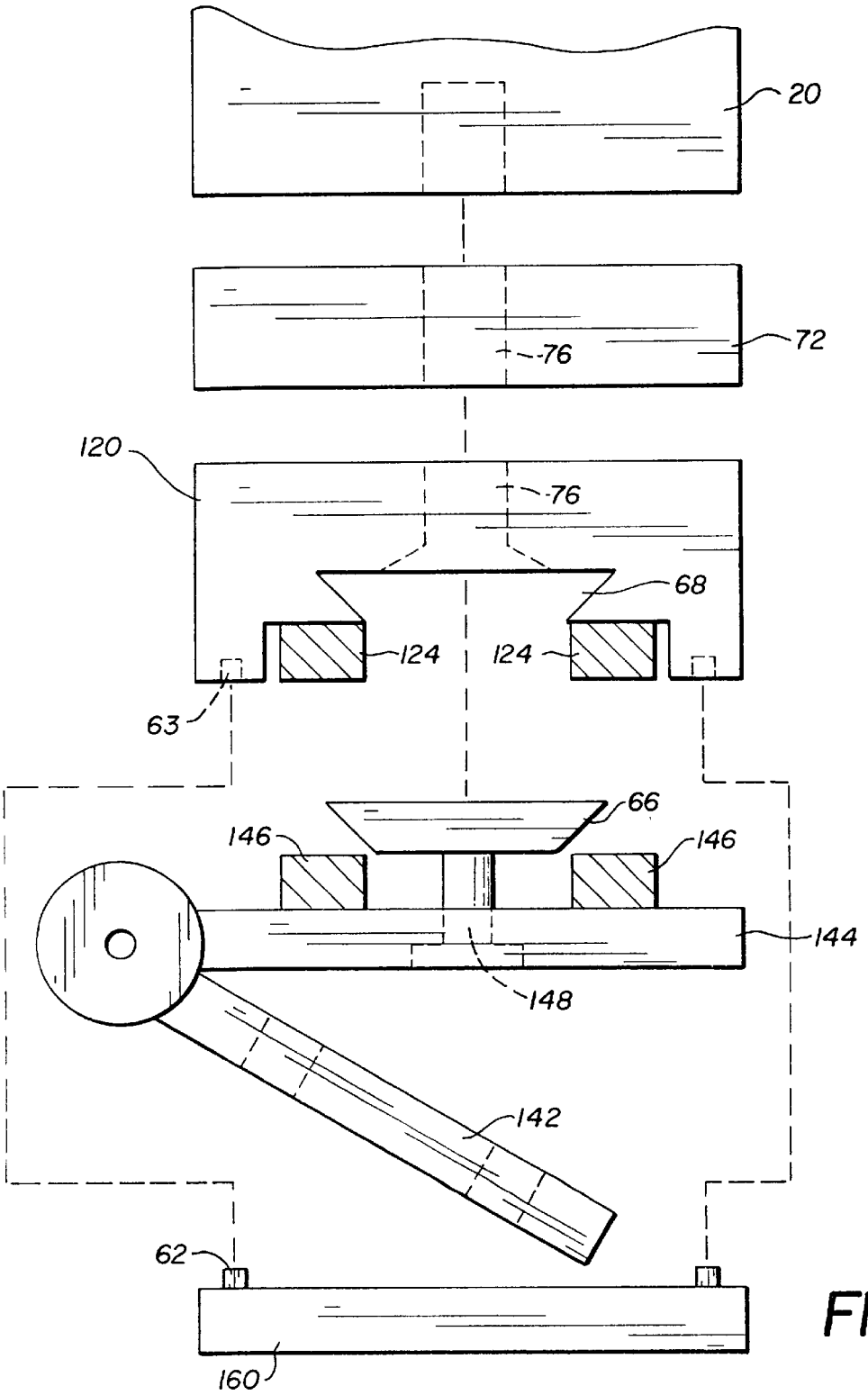
FIG. 5 is an exploded top view of the hinge side of the adjustable door of the present invention showing the dovetail tongue retracted toward the door attaching member of the hinge.
Figure 6:
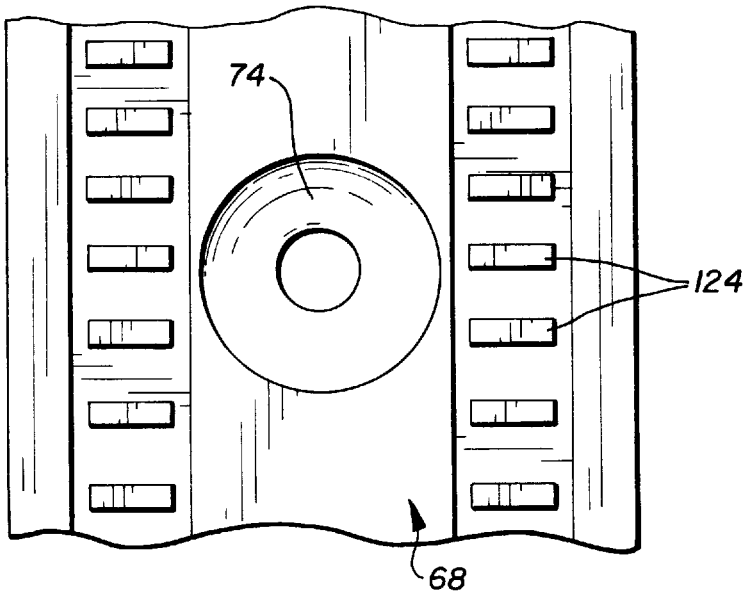
FIG. 6 is a side view of the end width extension member.
Figure 7:
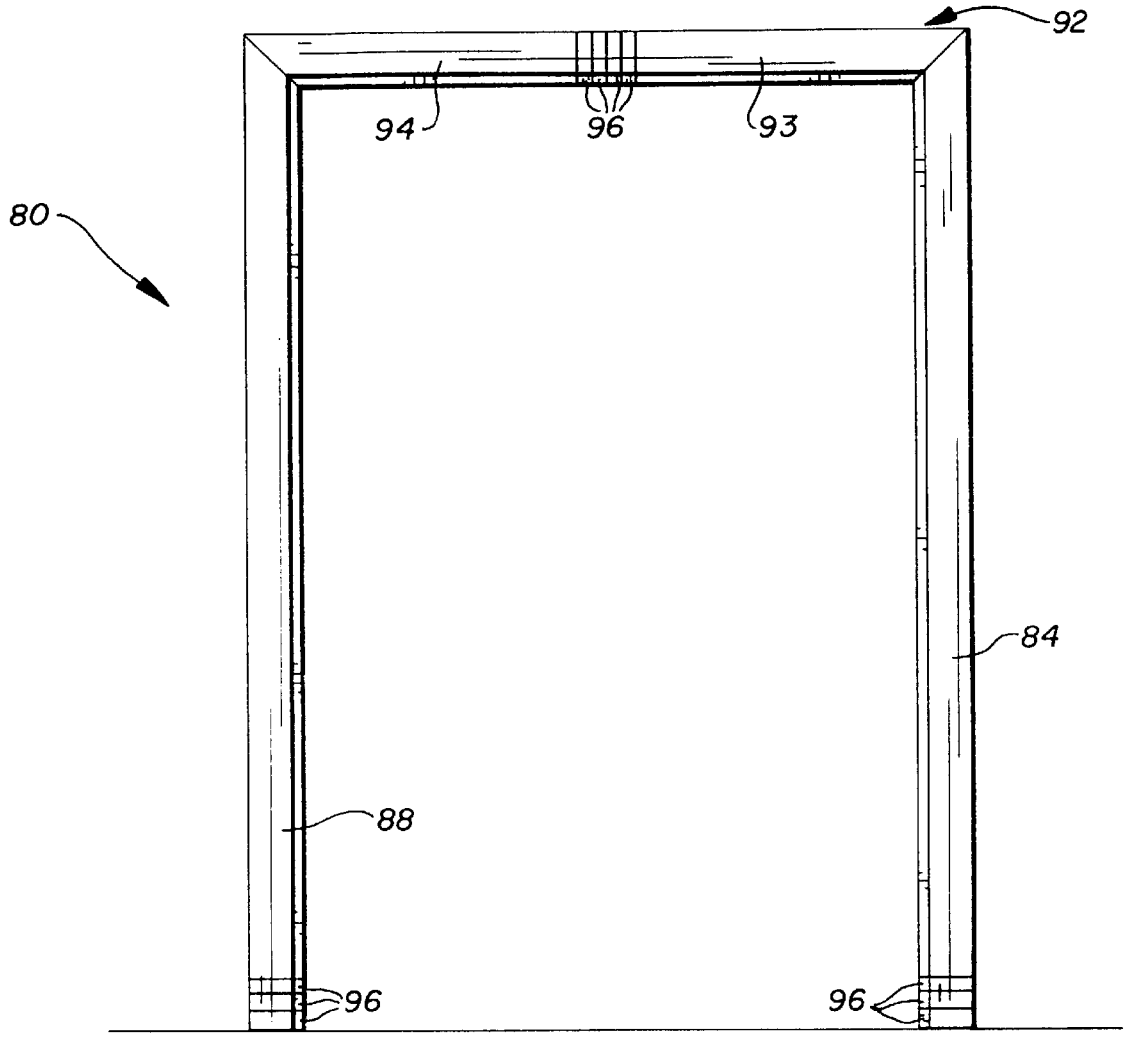
FIG. 7 is a front view of the adjustable door frame of the present invention.
Figure 8:
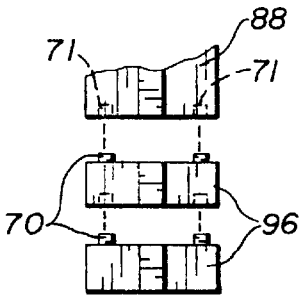
FIG. 8 is an exploded side view of the height adjustment means of the adjustable door frame.

The end width extension member 120 also has an adjustable hinge attaching assembly thereon. The adjustable hinge attaching assembly includes a dovetail groove 68 in the hinge side of the end width extension member 120, and a plurality of hinge engaging plates 124 extending perpendicularly from the hinge side of the end width extension member 120 on either side of the dovetail groove 68. This is shown in FIGS. 5 and 6.

The hinges 140 include a frame attaching member 142 and a door attaching member 144 which are pivotally connected. The door attaching member 144 has a plurality of door engaging plates 146 extending perpendicularly therefrom and a freely twisting bolt. 148 passing therethrough. The freely twisting bolt 148 spins freely within the door attaching member 144 so that a dovetail tongue 66 threadably attached to the distal end of the freely twisting bolt 148 may be urged towards or away from the door attaching member 144 when the freely twisting bolt 148 is twisted.

The hinges 140 may be attached to the end width extension member 120 at any height by sliding the dovetail tongue 66 on the distal end of the freely spinning bolt 148 into the dovetail groove 68 in the end width extension member 120 until the hinge 140 is appropriately positioned. At this point, the freely twisting bolt 148 is turned clockwise, thereby urging the dovetail tongue 66 toward the door attaching member 144 and thereby bringing the hinge engaging plates 124 into contact with the door engaging plates 146 to lock the hinge 140 in place. To move the hinges 140 again, the freely twisting bolt 148 is turned counter clockwise to urge the dovetail tongue 66 away from the door attaching member 144 and bring the door engaging plates 146 and the hinge engaging plates 124 out of contact, thus allowing the hinge 140 to be moved.

The end width extension member 120 also has a plurality of pin holes 63 in the hinge side thereof (shown in dashed lines in FIG. 5) running in parallel rows outside of the hinge engaging plates 124. These pin holes 63 in the end width extension member 120 interfit with a plurality of pins 62 running in parallel rows along a hinge side cover 160. The hinge side cover 160 is of the same thickness as the door attaching member 144 so that it may be attached to the end width extension member 120 between the hinges 140 and between the hinges 140 and the ends of the hinge side of the door 10 to bring the hinge side of the door 10 flush with the door attaching member 144 of the hinge 140. The hinge side cover 160 is scored at regular intervals along its length to allow it to be broken into variably sized pieces that will fit in the spaces between the hinges 140 and between the hinges 140 and the ends of the hinge side of the door 10. The hinge side cover piece 160 is shown broken into appropriately sized pieces along the hinge side of the door 10 in FIG. 2.

Figure 10:
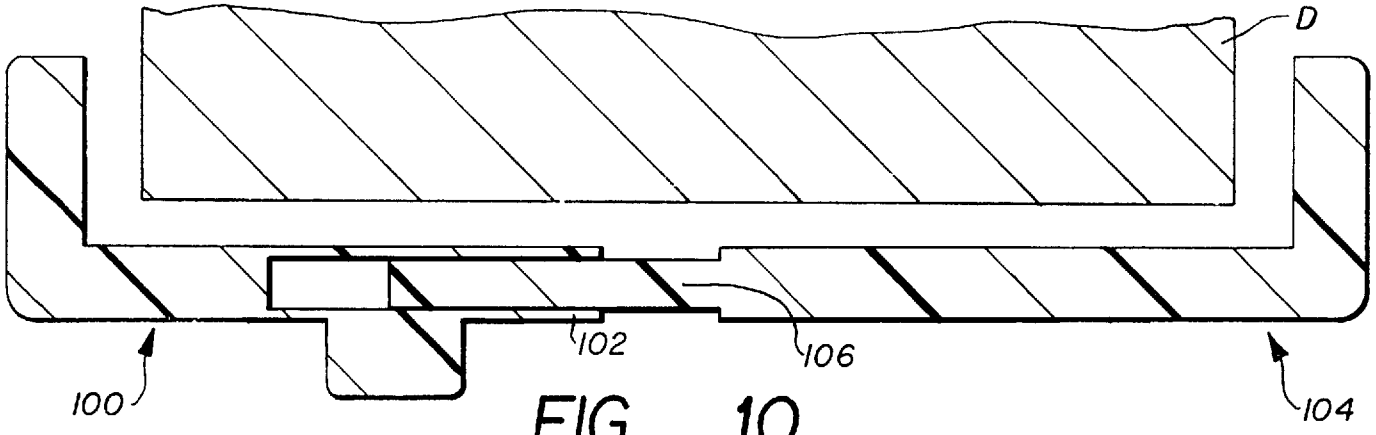
FIG. 10 is a cross sectional view of the interfitting pieces of the adjustable door frame in a separated position around a door opening.
Figure 11:
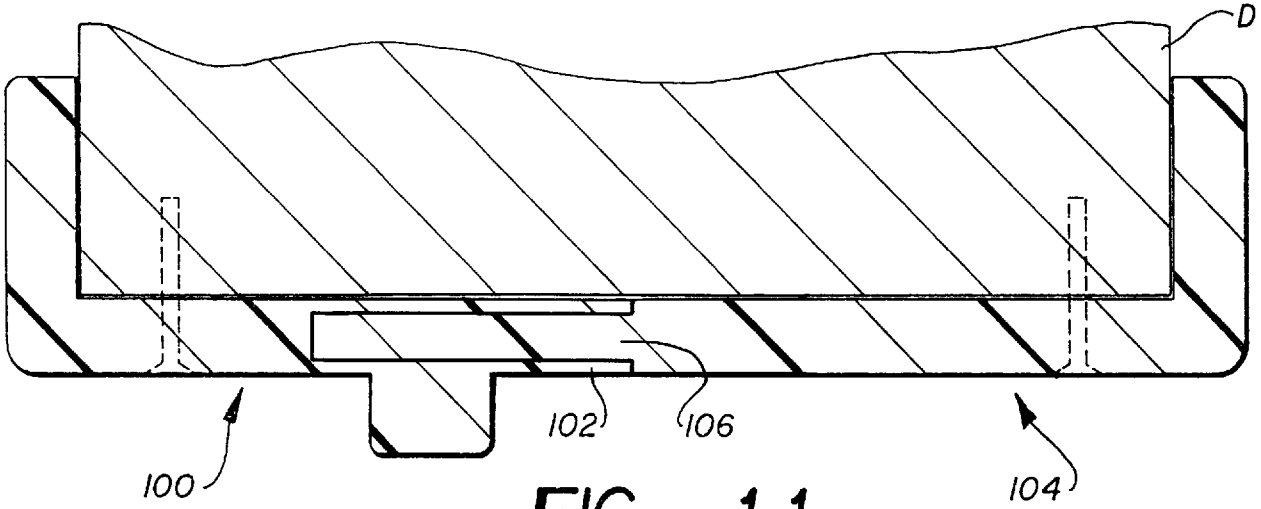
FIG. 11 is a cross sectional view of the interfitting members of the adjustable door frame mounted to a door opening.

The frame 80 is also made of plastic materials and is comprised of a hinge jamb member 84, a strike jamb member 88, a header member 92, and a plurality of frame extension members 96. These members are all made up of a door strike member 100 with a groove 102 therein and a door facing member 104 with a tongue 106 thereon which are shown in cross section in FIGS. 10 and 11. When installed on a wall end D the door strike member 100 and the facing member 104 are placed on opposite sides of the wall end D and pressed together until they engage opposite sides of the wall end D and the tongue 106 extends into the groove 102. The door strike member 100 and facing member 104 are then secured to the wall end by a fastening means such as spiral pounding nails. The hinge jamb member 84, the strike jamb member 88, the header member 92, and the frame extension members 96 may be attached to walls of different thicknesses because the degree to which the tongue 106 extends into the tapered groove 102 may be varied without changing the finished appearance of the frame.

The hinge jamb member 84 is attached to a door opening adjacent the hinge side of the door 10, the strike jamb member is attached to the door opening adjacent the swinging side of the door 10, and the header member 92 is attached to the top of the door opening to define a rectangular opening with the floor.

The hinge jamb member 84 and the strike jamb member 88 are long members which are mitered at their top ends and which have a plurality of height extension members 96 at their bottom ends. The header member 92 has a hinge side portion 93 and a swinging side portion 94 which are connected by frame extension members 96 and which are mitered at their distal ends so that they connect at right angles to the hinge jamb member 84 and the strike jamb member 88.

The frame extension members 96 have the same cross sectional dimensions as the hinge jamb member 84, the strike jamb member 88, and the header member 92 but they are greatly reduced in their length so that the height and width of the door frame 80 may be changed incrementally by adding varying numbers of frame extension members 96 to the hinge jamb member 84, the strike jamb member 88, and the header member 92.

Figure 9:
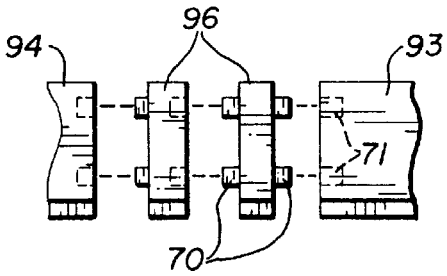
FIG. 9 is an exploded front view of the width adjustment means of the adjustable door frame.

The frame extension members 96 have a first side with a plurality of pegs 70 extending therefrom and a second side with a plurality of peg holes 71 therein. The pegs 70 and peg holes 71 interfit to allow the frame extension members 96 to be removably attached to each other. The bottom ends of the hinge jamb member 84 and the strike jamb member 88 also have a plurality of peg holes 71 therein to allow the frame extension members 96 to be removably attached thereto. The proximal ends of the hinge side portion 93 and the swinging side portion 94 of the header member 92 also have a plurality of peg holes 71 therein to allow the frame extension members 96 to be removably attached thereto. One frame extension member 96 may have pegs 70 extending from both sides thereof so that it may connect a side of a frame member with peg holes 71 therein to a side of anther frame member with peg holes 71 therein as shown in FIG. 9.

It is to be understood that the present invention is not limited to the embodiments described above, but encompasses any and all embodiments within the scope of the following claims.

I claim:

1. An adjustable door and frame assembly for universal installation in door openings comprising:

a door having a height and a width, including a core including a top, a bottom, a hinge side, a swinging side, and receiver means for receiving a door knob, a plurality of extension means for selectively adjusting the height and width of said door, and a plurality of corner means for maintaining the height and width of said door; and a frame including a first jamb, a second jamb, a header, and a plurality of frame extension members, said first jamb being attached to door openings in opposition to said hinge side of said door, said second jamb being attached to door openings in opposition to said swinging side of said door, and said header being attached to door openings in opposition to said top of said door;

said first jamb and said second jamb having a top end, and a bottom end, a portion of said frame extension members being removably disposed at said bottom ends of said first jamb and said second jamb;

said header member including a first side portion and a second side portion, said first side portion and said second side portion being separated by another portion of said plurality of said frame extension members.

2. adjustable door and frame assembly for universal installation in door openings comprising:

a door having a top, a bottom, a hinge side, and a swinging side, said door further including a plurality of height extension members having a hinge side and a swinging side, said height extension members being removably attached to said bottom side of said core piece, a plurality of width extension members having a top end, a bottom end, a hinge side and a door side, said width extension members being removably attached to said hinge side of said core piece, and a plurality of corner pieces removably attached to said hinge side of said height extension members to bring the height extension members flush with said hinge side of said door; and a frame including a hinge jamb member, a strike jamb member, a header member, and a plurality of frame extension members, said hinge jamb member being attached to the door opening adjacent said hinge side of said door, said strike jamb member being attached to the door opening adjacent said swinging side of said door, and. said header member being attached to the door opening adjacent said top of said door to form a rectangular opening;

said hinge jamb member and said strike jamb member each having an upper end, and a lower end, some of said plurality of frame extension members being selectively attached to each said lower ends of said hinge jamb member and said strike jamb member;

said header member having a hinge side portion and a swinging side portion, said hinge side portion and said swinging side portion being interconnected by a plurality of said frame extension members;

wherein a width of said header member being varied by varying said plurality of said frame extension members.

3. An adjustable door and frame assembly for universal installation in door openings comprising:

a door having a top, a bottom, a hinge side, and a swinging side, said door further including;

a core piece including a top, a bottom, a hinge side, a swinging side, and receiver means for receiving a door knob, said receiver means being vertically adjustable;

a plurality of height extension members having a hinge side and a swinging side, said height extension members being removably attached to said bottom side of said core piece;

a plurality of width extension members having a top end, a bottom end, a hinge side and a door side, said width extension members being removably attached to said hinge side of said core piece; and a plurality of corner pieces removably attached to said hinge side of said height extension members to bring the height extension members flush with said hinge side of said door;

whereby the height and width of the door may be changed by attaching varying numbers of said height extension members, said width extension members, and said corner pieces to said core piece; and a frame including a hinge jamb member, a strike jamb member, and a header member, and a plurality of frame extension members, said hinge jamb member being attached to the door opening adjacent said hinge side of said door, said strike jamb member being attached to the door opening adjacent said swinging side of said door, and said header member being attached to the door opening adjacent said top of said door to form a rectangular opening;

said hinge jamb member and said strike jamb member having a top end, a bottom end, and a plurality of frame extension members, said frame extension members being removably attached to said bottom ends of said hinge jamb member and said strike jamb member;

said header member having a hinge side portion and a swinging side portion, said hinge side portion and said swinging side portion being detachably connected by a plurality of said frame extension members;

whereby the height and width of said frame may be adjusted by attaching varying numbers of frame extension members to said bottom ends of said strike jamb and said hinge jamb members and between said swinging side portion and said hinge side portion of said header member;

said hinge jamb, said strike jamb, said header, and said frame extension members being made up of a door strike member and a facing member, said door strike member having a tongue and said facing member having a groove, said tongue and said groove being interfitting;

whereby said tongue will extend into said groove when said door strike member and said facing member are mounted in the wall opening; and whereby the thickness of said frame may be changed by varying the degree to which said tongue extends into said groove to allow the frame to be mounted in wall openings is different thicknesses.

4. The adjustable door and frame assembly as defined in claim 3 wherein said core piece is hollow and constructed from a plastic material, said core piece further including:

a core piece frame with a front side and a rear side, said core piece frame having a top member, a bottom member, a hinge side member, and swinging side member being joined together to form a rectangle, said top, bottom, hinge side, and swinging side members having a front side and a rear side;

a plurality of vertical support strips having a top end and a bottom end, said top ends of said vertical support strips being attached to said front side and said rear side of said top member and said bottom ends of said vertical support strip being attached to said front side and said rear side of said bottom member to define planes on the front side of and rear side of said core piece;

a plurality of horizontal support strips having a hinge end and a swinging end, said hinge ends of said horizontal support strips being attached to said front side and said rear side of said hinge side member and said swinging ends of said horizontal support strip being attached to said front side and said rear side of said swinging side member to define planes on the front side of and rear side of said core piece; and two cover pieces, said cover pieces being attached to said front side and said rear side of said core piece to give the door a finished appearance.

5. The adjustable door and frame assembly as defined in claim 3 wherein adjustable door knob receiving means is made of a plastic material, said door knob receiving means comprising:

a door knob receiving frame with a hinge side and a swinging side, said door knob receiving frame having a top member, a bottom member, a hinge side member, said door knob receiving frame being joined with the swinging side member of the core piece frame to form a rectangle;

a door knob receiving block, said door knob receiving block being slidably held within said door knob receiving frame so that it may be moved vertically, said door knob receiving block being rectangular and having a front side, a rear side, a top, a bottom, a hinge side, and a swinging side, said door knob receiving block further having;

a knob hole drilled therethrough from said front said of said door knob receiving block to said rear side of said door knob receiving block; and a bolt hole drilled therein from said swinging side of said block to said cylindrical knob hole;

said swinging side member of said core piece frame having a bolt slot cut therein which is aligned with said bolt hole;

whereby said knob hole and said bolt hole are adapted to receive a door knob assembly so that a door knob bolt will protrude through said swinging side member of said core piece frame;

said door knob receiving block further having a plurality of threaded holes drilled therein and a plurality of flat head screws within said threaded holes;

said cover piece on said front of said door and said swinging side frame member having a plurality of slots cut therethrough for receiving said flat head screws, and both cover pieces having a pair of slots cut therein for receiving a door knob;

whereby said knob receiving block may be fixed at any height within said knob receiving frame by tightening said flat head screws against said cover piece.

6. The adjustable door and frame assembly as defined in claim 3 wherein said height extension members have a top, and a bottom, said top of said height extension member having a dovetail groove therein running from said hinge side to said swinging side of said height extension members, said bottom side of said height extension members having a dovetail tongue thereon running from said hinge side to said swinging side of said height extension members;

said bottom of said core piece having a dovetail tongue thereon running from said hinge side to said swinging side of said core piece;

whereby said dovetail tongues on said bottom of said core piece and on the bottom of said height extension members may slide into said dovetail grooves in said top of said height extension members so that a plurality of said height extension members may be removably attached to the bottom of the core piece;

said height extension member forming the bottom of the door being flat on its bottom to provide a finished appearance on the bottom of the door.

7. The adjustable door and frame assembly as defined in claim 3 wherein said height extension members have a top, and a bottom, said top of said height extension member having a plurality of pegs therein, said bottom side of said height extension members having a plurality of peg holes formed therein which interfit with said pegs so that the height extension members may be removably attached to each other;

said bottom of said core piece having plurality of holes formed therein so that said height extension members may be removably attached to said core piece;

said height extension member forming the bottom of the door being flat on its bottom to provide a finished appearance on the bottom of the door.

8. The adjustable door and frame assembly as defined in claim 3 wherein said door has a hinge attachment means, said hinge attachment means comprising:

an end width extension member, said end width extension member forming the hinge side of the door, said end width extension member having a top end, a bottom end, a hinge side and swinging side, said hinge side of said end width extension member having a dovetail groove therein running from said top of said end width extension member to the bottom of said end width extension member, said hinge side of said end width extension member further having a plurality of hinge engaging plates thereon running from said top of said end width extension member to said bottom of said end width extension member;

a hinge with a frame attaching member and a door attaching member, said frame attaching member and said door attaching member being pivotally connected;

said door attaching member having a plurality of door engaging plates thereon and having a freely twisting bolt therethrough, said bolt having a dovetail tongue threadably attached to its distal end;

whereby said dovetail tongue threadably attached to said bolt through said door attaching member may slide freely in said dovetail groove in said end width extension member until said bolt through said door attaching member is twisted to urge the dovetail tongue closer to said door attaching member and thereby bring said door engaging plates on said door attaching member into contact with said hinge engaging plates thereby fixing the hinge is place against the hinge side of the door.

9. The adjustable door and frame assembly as defined in claim 3 wherein said frame extension members have a first side and a second side, said first side having a plurality of pegs extending therefrom, said second side having a plurality of holes formed therein which interfit with said pegs on said first side of said frame extension member to allow said extension members to be removably attached to each other; wherein said bottom ends of said hinge jamb member and said strike jamb member have a plurality of holes formed therein which interfit with said pegs on said frame extension members to allow said frame extension members to be removably attached to said strike jamb member and said hinge jamb member; wherein said hinge side portion and said swinging side portion of said header member have a plurality of holes therein which interfit with said pegs on said frame extension members to allow said frame extension members to be removably attached to said hinge side portion of said header member; and wherein said frame has a double peg frame extension member having a first side and a second side, said first side and said second side having a plurality of pegs therein so that it may attach said second side of said frame extension member to said swinging side portion or said hinge side portion of said frame member.

10. The adjustable door and frame assembly as defined in claim 3 wherein said door further includes a hinge side cover means, said hinge side cover means comprising:

a hinge side cover being scored to allow the hinge cover to be broken into variably sized pieces, said hinge side cover having a door side and a frame side, said door side having a plurality of pins thereon, said frame side being a smooth surface;

said end width extension member having a plurality of pin holes formed therein which interfit with said pins in said hinge side cover;

whereby said hinge side cover may be broken into pieces of a length equal to the distance between said hinges and between said hinges and the top and the bottom of the door and removably attached to said hinge side of said door to form a flush surface with the hinges.

* * * * *